US007268523B2

(12) United States Patent
Itoh

(10) Patent No.: US 7,268,523 B2
(45) Date of Patent: Sep. 11, 2007

(54) CONSTANT VOLTAGE POWER SUPPLY CIRCUIT AND METHOD OF TESTING THE SAME

(75) Inventor: Kohzoh Itoh, Hyogo (JP)

(73) Assignee: Ricoh Company Ltd., Tokyo (JP)

( * ) Notice: Subject to any disclaimer, the term of this patent is extended or adjusted under 35 U.S.C. 154(b) by 0 days.

(21) Appl. No.: 11/370,914

(22) Filed: Mar. 9, 2006

(65) Prior Publication Data

US 2006/0208663 A1 Sep. 21, 2006

(30) Foreign Application Priority Data

Mar. 16, 2005 (JP) ..... 2005-075229

(51) Int. Cl.
*G05F 1/569* (2006.01)
*G05F 3/26* (2006.01)

(52) U.S. Cl. ..... 323/276

(58) Field of Classification Search ..... 323/274, 323/275, 276, 277, 278, 279, 281, 315, 316; 324/771
See application file for complete search history.

(56) References Cited

U.S. PATENT DOCUMENTS 6,529,065 B2 * 3/2003 Forstner et al. ..... 327/538
7,042,280 B1 * 5/2006 Huang et al. ..... 327/541

FOREIGN PATENT DOCUMENTS

JP 2002-169618 A 6/2002
JP 2003-067062 A 3/2003

* cited by examiner

*Primary Examiner*—Gary L Laxton
(74) *Attorney, Agent, or Firm*—Dickstein Shapiro LLP

(57) ABSTRACT

A constant voltage power supply circuit is provided with a constant voltage circuit part to convert an input voltage into a predetermined constant voltage, a first excessive current protection circuit part to control the constant voltage circuit part so as to reduce the output voltage while maintaining an output current that is output to a predetermined maximum value if the output current is greater than or equal to the predetermined maximum value when the output voltage is a rated voltage, and a second excessive current protection circuit part to control the constant voltage circuit part so as to reduce the output voltage and the output current and to output a short-circuit current if the output voltage decreases to a ground voltage when the output voltage is decreased to a predetermined value by the first excessive current protection circuit part. The second excessive current protection circuit part is disabled in response to a first test signal that is active.

14 Claims, 8 Drawing Sheets

CONSTANT VOLTAGE POWER SUPPLY CIRCUIT AND METHOD OF TESTING THE SAME

BACKGROUND OF THE INVENTION

1. Field of the Invention

The present invention generally relates to, and more particularly to constant voltage power supply circuits and methods of testing the same, and more particularly to a constant voltage power supply circuit having an excessive current protection circuit, and to a method of testing such a constant voltage power supply circuit by accurately measuring a set current value of the excessive current protection circuit.

2. Description of the Related Art

Conventionally, an excessive current protection circuit is provided for suppressing an output current of a constant voltage power supply circuit to a predetermined current value or less, so as to prevent damage to the load or power supply circuit, even if the output current of the constant voltage power supply circuit abnormally increases due to an excessive load, a short-circuiting of an output terminal and the like.

As general methods employed in excessive current protection circuits, there is a first method that reduces the output voltage by suppressing an increase of the output current beyond a predetermined current if the output current increases up to the predetermined current, and a second method that reduces the output current and also reduces the output current. According to the second method, the voltage-current characteristic that is obtained generally forms the shape of the numeral "7". The increase in the output power, which is the product of the output current and the output voltage, is small according to the second method, and the power consumption within the power supply circuit during operation of the excessive current protection circuit is relatively small. For this reason, although the circuit structure becomes slightly complex, inexpensive parts may be used in the power supply circuit, thereby making the second method popular.

FIG. 1 is a circuit diagram showing an example of a conventional constant voltage power supply circuit having an excessive current protection circuit employing both the first and second methods. For example, the constant voltage power supply circuit may be derived from Japanese Laid-Open Patent Applications No. 2002-169618 and No. 2003-67062.

In FIG. 1, a constant voltage power supply circuit 100 forms a series regulator having a first excessive current protection circuit 101 employing the first method and a second excessive current protection circuit 102 employing the second method.

FIG. 2 is a diagram showing an output current versus output voltage characteristic of the constant voltage power supply circuit 100 shown in FIG. 1. In FIG. 2, the ordinate indicates an output voltage Vo, and the abscissa indicates an output current io, both in arbitrary units.

Next, a description will be given of the excessive current protection operation of the first and second excessive current protection circuits 101 and 102, by referring to FIG. 2.

The element size of a PMOS transistor M2 shown in FIG. 1 is sufficiently small compared to that of a PMOS transistor M1 for output voltage control. For this reason, a drain current id2 of the PMOS transistor M2 is smaller than a drain current id1 of the PMOS transistor M1. However, the gates of the PMOS transistors M1 and M2 are connected to an output terminal of a differential amplifier circuit A1, and the sources of the PMOS transistors M1 and M2 are connected to a power supply voltage Vdd. Hence, the drain current id2 is proportional to the drain current id1. A reference voltage Vref generated from a reference voltage generating circuit 2 is input to an inverting input terminal of the differential amplifier circuit A1.

The drain current id2 becomes a drain current id3 of an NMOS transistor M3 which forms a current mirror circuit together with an NMOS transistor M4. Accordingly, a drain current id4 of the NMOS transistor M4 is proportional to the drain current id2. In addition, when the NMOS transistors M3 and M4 are formed by transistors having the same characteristics, the drain current id4 becomes equal to the drain current id2.

The drain current id1 is a sum of the output current io and a current ir that flows through a series circuit made up of resistors R1 and R2. But since the current ir is set to an extremely small current value, the drain current id1 may be considered as being equal to the output current io for current values at which the excessive current protection circuit operates. For this reason, the drain current id4 of the NMOS transistor M4 is also proportional to the drain current id1, that is, proportional to the output current io. Moreover, since the drain current id4 flows to a resistor R3, a voltage drop across the resistor R3 is proportional to the output current io.

When the output current io reaches a maximum load current imax at a point c in FIG. 2, the voltage drop across the resistor R3 becomes a threshold voltage of a PMOS transistor M5. Furthermore, when the output current io exceeds the maximum load current imax, the PMOS transistor M5 turns ON to increase the gate voltage of the PMOS transistor M1, so as to suppress the increase of the drain current id1 of the PMOS transistor M1, that is, the increase of the output current io. Consequently, the output voltage Vo decreases in a state where the output current io remains to be the maximum load current imax, as shown in FIG. 2.

In addition, the element size of a PMOS transistor M6 is sufficiently small compared to that of the PMOS transistor M1. The gate of the PMOS transistor M6 is connected to the output terminal of the differential amplifier circuit A1, and the source of the PMOS transistor M6 is connected to the power supply voltage Vdd, similarly to the PMOS transistors M1 and M2 described above. Hence, a drain current id6 of the PMOS transistor M6 is also proportional to the output current io. Since the drain current id6 flows to a resistor R4, a voltage drop across the resistor R4 is proportional to the output current io.

In addition, when the output voltage Vo decreases, an output voltage of a differential amplifier circuit A2 decreases, so as to lower the gate voltage of a PMOS transistor M7. Hence, the PMOS transistor M7 turns ON and raises the gate voltage of the PMOS transistor M1, and the drain current id1 decreases. As a result, the output voltage Vo further decreases, and both the output voltage Vo and the output current io decrease as shown in FIG. 2. A short-circuit current is indicated at a point C in FIG. 2 is the current that flows when the output voltage Vo decreases to 0 V.

A non-inverting input terminal of the differential amplifier circuit A2 is connected, via an offset voltage generating circuit 7 that generates an offset voltage Vs, to a node that connects the resistors R1 and R2. However, when a resistor for use in detecting the output voltage is additionally provided, a different voltage may be input to the non-inverting input terminal of the differential amplifier circuit A2.

When testing the constant voltage power supply circuit 100, it is necessary to measure the current values of the maximum load current imax and the short-circuit current is described above. However, it is difficult to accurately measure such current values.

For example, when measuring the current values of the maximum load current imax and the short-circuit current is of the constant voltage power supply circuit 100 shown in FIG. 1, an ammeter 13 and a dummy load 12 are connected to an output terminal OUT. In this case, it is impossible to accurately set the output voltage Vo that is required to measure the maximum load current imax and the short-circuit current is due to the contact resistance of the output terminal OUT or the contact resistance of the connection terminal of the dummy load 12 that connects to the ground voltage. In addition, because the output voltage Vo does not accurately decrease to 0 V, even though the short-circuit current is should originally have the current value at the point C shown in FIG. 2, the current value at a point D is actually measured, and an accurate measurement of the short-circuit current is is difficult. In FIG. 2, Voscm indicates the voltage value of the output voltage Vo when measuring the short-circuit current is.

Moreover, if the excessive current protection circuit consists solely of the second excessive current protection circuit 102 or, a voltage value Vo1 of the output voltage Vo at which the second excessive current protection circuit 102 starts to operate is close to a rated output voltage Voro, the output current io becomes unstable. As a result, even though the maximum load current imax should originally have the current value at the point c shown in FIG. 2, the current value at a point d is actually measured, and an accurate measurement of the maximum load current imax is also difficult.

SUMMARY OF THE INVENTION

Accordingly, it is a general object of the present invention to provide a novel and useful constant voltage power supply circuit and method of testing the same, in which the problems described above are suppressed.

Another and more specific object of the present invention is to provide a constant voltage power supply circuit and a method of testing the same, which enable accurate measurement of a maximum load current and/or a short-circuit current, without requiring a complex circuit structure.

Still another and more specific object of the present invention is to provide a constant voltage power supply circuit for converting an input voltage received via an input terminal into a predetermined constant voltage that is output via an output terminal to a load which is coupled to the output terminal, comprising a constant voltage circuit part configured to convert the input voltage into the predetermined constant voltage; a first excessive current protection circuit part configured to control the constant voltage circuit part so as to reduce the output voltage while maintaining an output current that is output via the output terminal to a predetermined maximum value if the output current is greater than or equal to the predetermined maximum value when the output voltage is a rated voltage; and a second excessive current protection circuit part configured to control the constant voltage circuit part so as to reduce the output voltage and the output current and to output a short-circuit current via the output terminal if the output voltage decreases to a ground voltage when the output voltage is decreased to a predetermined value by the first excessive current protection circuit part, wherein the second excessive current protection circuit part is disabled in response to a first test signal that is active. According to the constant voltage power supply circuit of the present invention, it is possible to easily and accurately measure the maximum load current and/or the short-circuit current, without requiring a complex circuit structure.

A further object of the present invention is to provide a constant voltage power supply circuit for converting an input voltage received via an input terminal into a predetermined constant voltage that is output via an output terminal to a load which is coupled to the output terminal, comprising a constant voltage circuit part configured to convert the input voltage into the predetermined constant voltage; and a second excessive current protection circuit part configured to control the constant voltage circuit part so as to reduce the output voltage and an output current that is output from the output terminal and to output a short-circuit current via the output terminal if the output voltage decreases to a ground voltage when the output current is greater than or equal to a predetermined maximum value in a state where the output voltage is a rated voltage, wherein the second excessive current protection circuit part controls the constant voltage circuit part to reduce the output voltage to the ground voltage when the output current becomes greater than or equal to the short-circuit current in response to a second test signal that is active. According to the constant voltage power supply circuit of the present invention, it is possible to easily and accurately measure the short-circuit current, without requiring a complex circuit structure.

Another object of the present invention is to provide a method of testing a constant voltage power supply circuit comprising a constant voltage circuit part configured to convert an input voltage that is input via an input terminal into a predetermined constant voltage that is output via an output terminal, a first excessive current protection circuit part configured to control the constant voltage circuit part so as to reduce the output voltage while maintaining an output current that is output via the output terminal to a predetermined maximum value if the output current is greater than or equal to the predetermined maximum value when the output voltage is a rated voltage, and a second excessive current protection circuit part configured to control the constant voltage circuit part so as to reduce the output voltage and the output current and to output a short-circuit current via the output terminal if the output voltage decreases to a ground voltage when the output voltage is decreased to a predetermined value by the first excessive current protection circuit part, the method comprising stopping operation of the second excessive current protection circuit part in response to a first test signal that is active; reducing the output voltage to the ground voltage by adjusting a current flowing to a load that is coupled to the output terminal; and measuring the output current. According to the method of the present invention, it is possible to easily and accurately measure the maximum load current and/or the short-circuit current, without requiring a complex circuit structure.

Still another object of the present invention is to provide a method of testing a constant voltage power supply circuit comprising a constant voltage circuit part configured to convert an input voltage that is input via an input terminal into a predetermined constant voltage that is output via an output terminal, and a second excessive current protection circuit part configured to control the constant voltage circuit part so as to reduce the output voltage and an output current that is output from the output terminal and to output a short-circuit current via the output terminal if the output voltage decreases to a ground voltage when the output current is greater than or equal to a predetermined maximum value in a state where the output voltage is a rated voltage, the method comprising releasing an input end configured to receive a voltage proportional to the output voltage by the second excessive current protection circuit part in response to a second test signal that is active; controlling the input end to the ground voltage by the second excessive current protection circuit part regardless of the output voltage; adjusting a current flowing to a load that is coupled to the output terminal so as to reduce the output voltage to the ground voltage; and measuring the output current. According to the method of the present invention, it is possible to easily and accurately measure the short-circuit current, without requiring a complex circuit structure.

Other objects and further features of the present invention will be apparent from the following detailed description when read in conjunction with the accompanying drawings.

DESCRIPTION OF THE PREFERRED EMBODIMENTS

A description will be given of embodiments of a constant voltage power supply circuit according to the present invention and a method of testing the constant voltage power supply circuit according to the present invention, by referring to FIG. 3 and the subsequent figures.

First Embodiment

Figure 1:
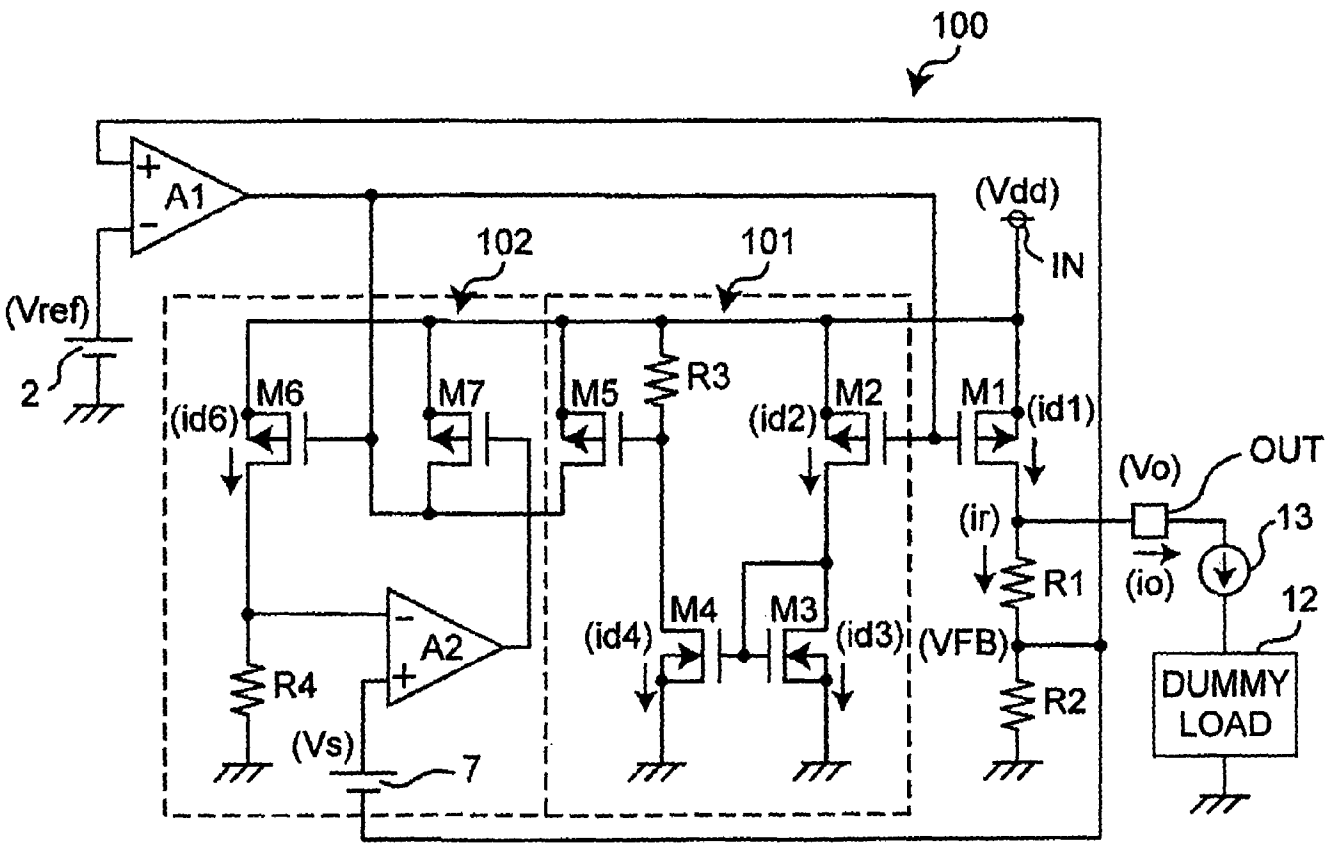
FIG. 1 is a circuit diagram showing an example of a conventional constant voltage power supply circuit having an excessive current protection circuit employing both the first and second methods.
Figure 2:
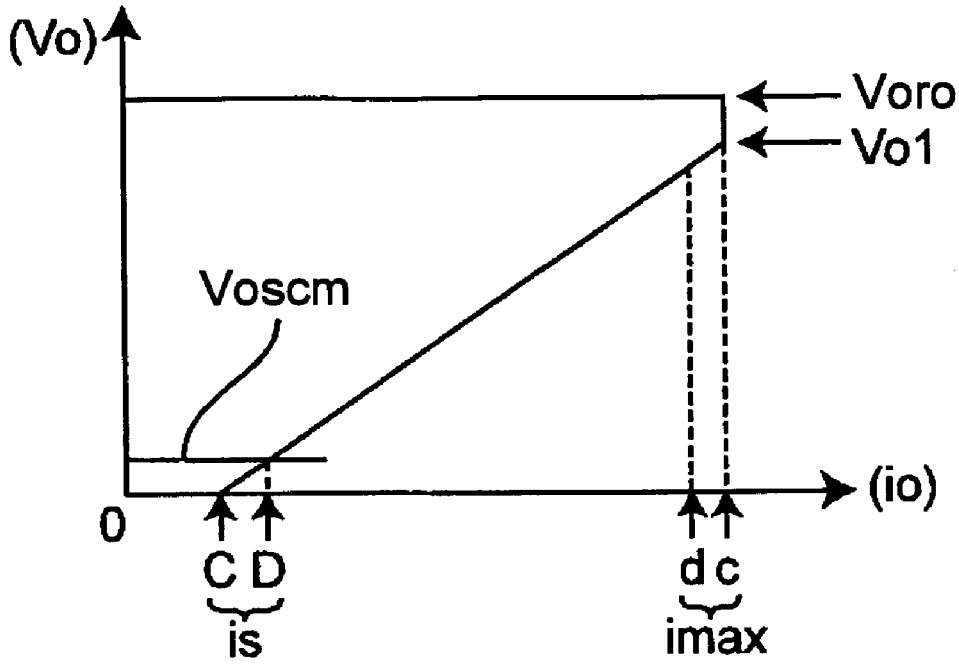
FIG. 2 is a diagram showing an output current versus output voltage characteristic of the constant voltage power supply circuit shown in FIG. 1.
Figure 3:
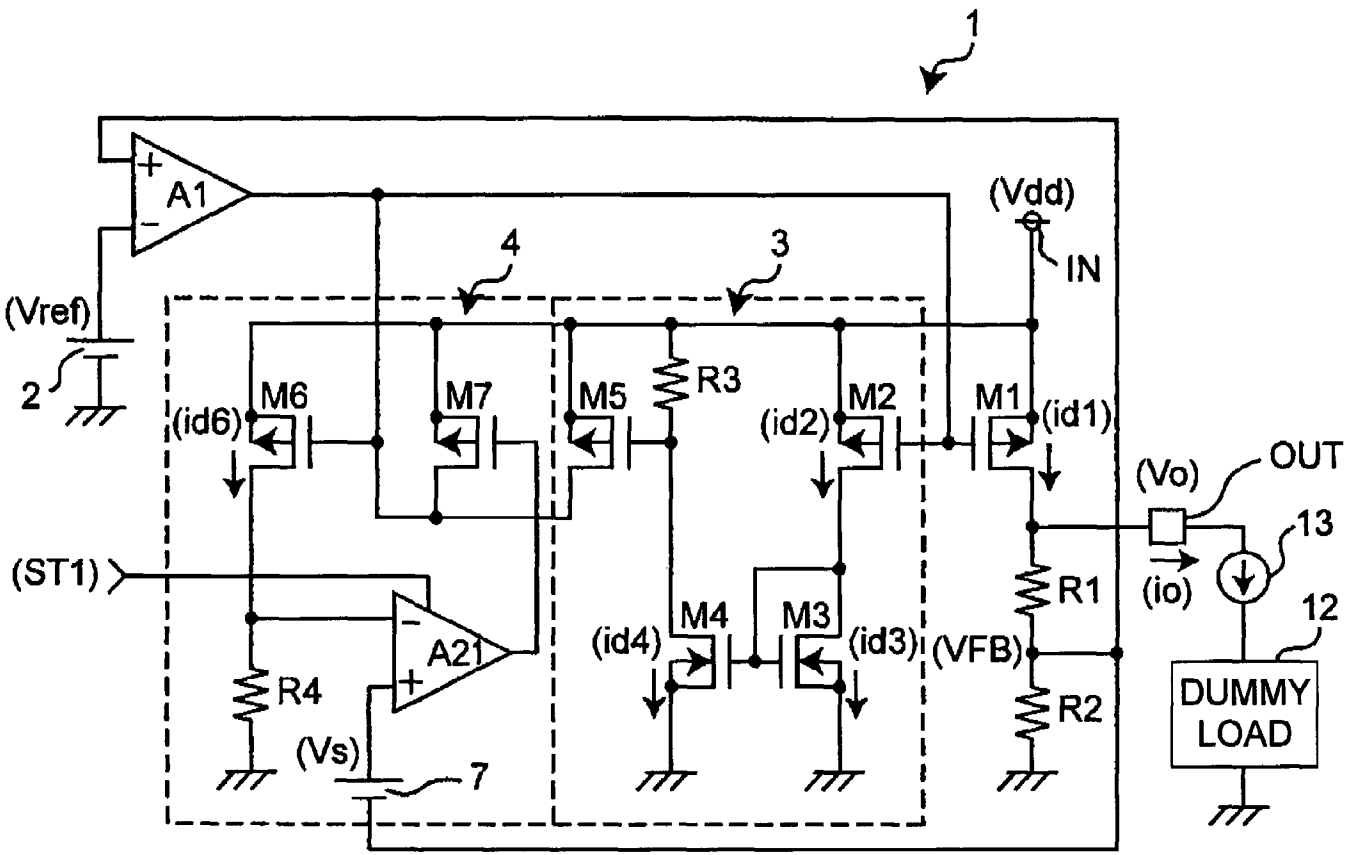
FIG. 3 is a circuit diagram showing a first embodiment of a constant voltage power supply circuit according to the present invention.

FIG. 3 is a circuit diagram showing a first embodiment of the constant voltage power supply circuit according to the present invention. This first embodiment of the constant voltage power supply circuit employs a first embodiment of the method of testing the constant voltage power supply circuit according to the present invention. In FIG. 3, those parts which are essentially the same as those corresponding parts in FIG. 1 are designated by the same reference numerals.

A constant voltage power supply circuit 1 shown in FIG. 3 may be integrated within a semiconductor device having predetermined functions. A power supply voltage Vdd is input to an input terminal IN, and an output voltage Vo, which is a predetermined constant voltage generated in the constant voltage power supply circuit 1, is output via an output terminal OUT.

The constant voltage power supply circuit 1 includes a reference voltage generating circuit 2 for generating a predetermined reference voltage Vref, resistors R1 and R2 for dividing the output voltage Vo to generate a divided voltage VFB and for detecting the output voltage Vo, a PMOS transistor M1 for controlling the output voltage Vo by controlling an output current io that is output to the output terminal OUT depending on a signal input to the gate thereof, and a differential amplifier circuit A1 for controlling the operation of the PMOS transistor M1 so that the divided voltage VFB becomes the reference voltage Vref. The constant voltage power supply circuit 1 further includes a first excessive current protection circuit 3 and a second excessive current protection circuit 4. When the output current io output from the output terminal OUT increases to a predetermined current value, the first excessive current protection circuit 3 suppresses the increase of the output current io beyond the predetermined current value and reduces the output voltage Vo. When the output voltage Vo is decreased to a predetermined voltage value Vo1 by the first excessive current protection circuit 3, the second excessive current protection circuit 4 reduces the output voltage Vo and the output current io.

The first excessive current protection circuit 3 includes PMOS transistors M2 and M5, NMOS transistors M3 and M4, and a resistor R3. The second excessive current protection circuit 4 includes a differential amplifier circuit A21, PMOS transistors M6 and M7, a resistor R4, and an offset voltage generating circuit 7 for generating an offset voltage Vs that is added to a voltage that is input to a non-inverting input terminal of the differential amplifier circuit A21.

The reference voltage generating circuit 2, the differential amplifier circuit A1 and the resistors R1 and R2 form an output voltage control part. The output voltage control part and the PMOS transistor M1 form a constant voltage circuit part that converts the input voltage received via the input terminal IN into a predetermined constant voltage (that is, the output voltage Vo) that is output via the output terminal OUT. The first excessive current protection circuit 3 forms a first excessive current protection circuit part, and the second excessive current protection circuit 4 forms a second excessive current protection circuit part. In addition, the PMOS transistor M6 and the resistor R4 form a current-to-voltage conversion circuit, and the offset voltage generating circuit 7 forms an offset voltage generating part. Furthermore, the offset voltage generating circuit 7, the PMOS transistor M7 and the differential amplifier circuit A21 form a control circuit.

The PMOS transistor M1 is connected between the input terminal IN and the output terminal OUT. The resistors R1 and R2 are connected in series between the output terminal OUT and the ground voltage. The reference voltage Vref is input to an inverting input terminal of the differential amplifier circuit A1, and the divided voltage VFB which is obtained from a node connecting the resistors R1 and R2 is input to a non-inverting input terminal of the differential amplifier circuit A1. An output terminal of the differential amplifier circuit A1 is connected to the gate of the PMOS transistor M1.

In the first excessive current protection circuit 3, the source of the PMOS transistor M2 is connected to the input terminal IN, and the gate of the PMOS transistor M2 is connected to the gate of the PMOS transistor M1. The NMOS transistor M3 is connected between the drain of the PMOS transistor M2 and the ground voltage. The gate of the NMOS transistor M3 is connected to the drain of the NMOS transistor M3. The NMOS transistor M4 forms a current mirror circuit together with the NMOS transistor M3. The source of the NMOS transistor M4 is connected to the ground voltage, and the gate of the NMOS transistor M4 is connected to the gate of the NMOS transistor M3. The resistor R3 is connected between the input terminal IN and the drain of the NMOS transistor M4. The gate of the PMOS transistor M5 is connected to a node connecting the resistor R3 and the drain of the NMOS transistor M4, and the source of the PMOS transistor M5 is connected to the input terminal IN. The drain of the PMOS transistor M5 is connected to the gate of the PMOS transistor M1.

In the second excessive current protection circuit 4, the gate of the PMOS transistor M6 is connected to the gate of the PMOS transistor M1, and the source of the PMOS transistor M6 is connected to the input terminal IN. The resistor R4 is connected between the drain of the PMOS transistor M6 and the ground voltage. A node connecting the PMOS transistor M6 and the resistor R4 is connected to the inverting input terminal of the differential amplifier circuit A21. The offset voltage generating circuit 7 inputs to the non-inverting input terminal of the differential amplifier circuit A21 the voltage which is obtained by adding the offset voltage Vs to the divided voltage VFB. The output terminal of the differential amplifier circuit A21 is connected to the gate of the PMOS transistor M7. In addition, the PMOS transistor M7 is connected between the input terminal IN and the gate of the PMOS transistor M1. An external first test signal ST1 is input to the differential amplifier circuit A21 from outside the constant voltage power supply circuit 1. The operation of the differential amplifier circuit A21 stops and the output terminal of the differential amplifier circuit A21 becomes a high level when the first test signal ST1 is active, that is, the first test signal ST1 has an active level.

The differential amplifier circuit A1 amplifies an error between the reference voltage Vref and the divided voltage VFB, and outputs the amplified error signal to the gate of the PMOS transistor M1. The operation of the PMOS transistor M1 is thus controlled by this amplified error signal so that the output voltage Vo is controlled to a constant voltage value.

Figure 4:
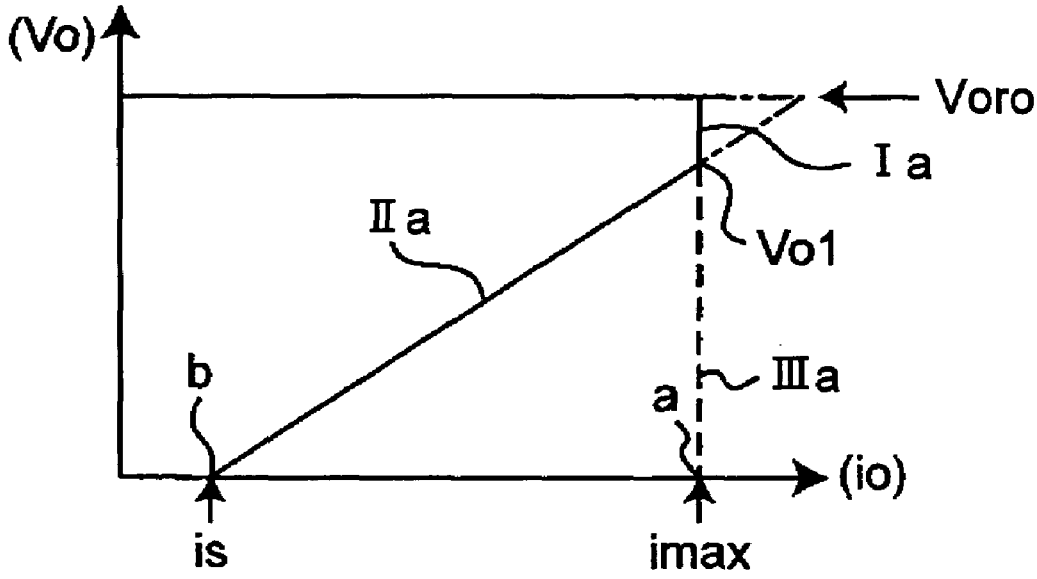
FIG. 4 is a diagram showing an output current versus output voltage characteristic of the constant voltage power supply circuit shown in FIG. 3.

FIG. 4 is a diagram showing an output current versus output voltage characteristic of the constant voltage power supply circuit 1 shown in FIG. 3. In FIG. 4, the ordinate indicates the output voltage Vo, and the abscissa indicates the output current io, both in arbitrary units. In FIG. 4, Ia indicates a limiting characteristic of the first excessive current protection circuit 3, IIa indicates a limiting characteristic of the second excessive current protection circuit 4, and IIIa indicates a characteristic of the first excessive current protection circuit 3 during the test operation.

Next, a description will be given of the operations of the first and second excessive current protection circuits 3 and 4 shown in FIG. 3 during a normal operation when the first test signal ST1 is inactive, that is, the first test signal ST1 has an inactive level, by referring to FIG. 4. The second excessive current protection circuit 4 is enabled in response to the inactive first test signal ST1.

The element size of the PMOS transistor M2 that is used is sufficiently small compared to that of the PMOS transistor M1, and thus, a drain current id2 of the PMOS transistor M2 is smaller than a drain current id1 of the PMOS transistor M1. But since the gates of the PMOS transistors M1 and M2 are connected in common to the output terminal of the differential amplifier circuit A1, and the sources of the PMOS transistors M1 and M2 are connected in common to the power supply voltage Vdd, the drain current id2 is proportional to the drain current id1.

The drain current id2 becomes a drain current id3 of the NMOS transistor M3 which forms a current mirror circuit together with the NMOS transistor M4. Accordingly, a drain current id4 of the NMOS transistor M4 is proportional to the drain current id2. In addition, when the NMOS transistors M3 and M4 are formed by transistors having the same characteristics, the drain current id4 becomes equal to the drain current id2.

The drain current id1 is a sum of the output current io and a current that flows through a series circuit made up of resistors R1 and R2. But since this current is set to an extremely small current value, the drain current id1 may be considered as being equal to the output current io for current values at which the excessive current protection circuit operates. For this reason, the drain current id4 of the NMOS transistor M4 is also proportional to the drain current id1, that is, proportional to the output current io. Moreover, since the drain current id4 flows to the resistor R3, a voltage drop across the resistor R3 is proportional to the output current io.

When the output current io reaches a maximum load current imax which is a rated maximum value of the output current io at a point a shown in FIG. 4, the first excessive current protection circuit 3 starts to operate, and the voltage drop across the resistor R3 becomes a threshold voltage of the PMOS transistor M5. Furthermore, when the output current io exceeds the maximum load current imax, the PMOS transistor M5 turns ON to increase the gate voltage of the PMOS transistor M1, so as to suppress the increase of the drain current id1 of the PMOS transistor M1, that is, the increase of the output current io. Consequently, the output voltage Vo decreases in a state where the output current io remains to be the maximum load current imax, as shown in FIG. 4.

In addition, the element size of the PMOS transistor M6 that is used is sufficiently small compared to that of the PMOS transistor M1. The gate of the PMOS transistor M6 is connected to the output terminal of the differential amplifier circuit A1, and the source of the PMOS transistor M6 is connected to the power supply voltage Vdd, similarly to the PMOS transistors M1 and M2 described above. Hence, a drain current id6 of the PMOS transistor M6 is also proportional to the output current io. Since the drain current id6 flows to the resistor R4, a voltage drop across the resistor R4 is proportional to the output current io.

In addition, when the output voltage Vo decreases to a voltage Vo1 shown in FIG. 4, the second excessive current protection circuit 4 starts to operate, and the voltage drop across the resistor R4 becomes equal to the voltage which is obtained by adding the offset voltage Vs to the divided voltage VFB. In addition, when the output voltage Vo decreases, an output voltage of the differential amplifier circuit A21 decreases, so as to lower the gate voltage of the PMOS transistor M7. Hence, the PMOS transistor M7 turns ON and raises the gate voltage of the PMOS transistor M1, and the drain current id1 decreases. As a result, the output voltage Vo further decreases, and both the output voltage Vo and the output current io decrease as shown in FIG. 4. A short-circuit current is indicated at a point b in FIG. 4 is the output current io that flows when the output voltage Vo decreases to 0 V. Therefore, when the first test signal ST1 is inactive, the constant voltage power supply circuit 1 operates as indicated by a solid line in FIG. 4.

The non-inverting input terminal of the differential amplifier circuit A21 is connected, via the offset voltage generating circuit 7 that generates the voltage Vs, to the node that connects the resistors R1 and R2. However, the connection is not limited to such. For example, the non-inverting input terminal of the differential amplifier circuit A21 may be connected, via the offset voltage generating circuit 7, to a voltage that is proportional to the output voltage Vo.

Next, a description will be given of the operation of the constant voltage power supply circuit 1 shown in FIG. 3 when the first test signal ST1 is active and a test operation is carried out. The second excessive current protection circuit 4 is disabled in response to the active first test signal ST1.

The first test signal ST1 is input to the differential amplifier circuit A21. As described above, the first test signal ST1 is set to be inactive during the normal operation, and the differential amplifier circuit A21 operates as described above during the normal operation. When testing the constant voltage power supply circuit 1, the current value of the maximum load current imax is be measured by connecting an ammeter 13 and a dummy load 12 between the output terminal OUT and the ground voltage. Since the first test signal ST1 is active during the test operation, the differential amplifier circuit A21 stops operating and the output terminal of the differential amplifier circuit A21 becomes a high level, to thereby turn OFF the PMOS transistor M7. Consequently, during the test operation, the second excessive current protection circuit 4 has no more effect on the gate voltage of the PMOS transistor M1.

Next, the dummy load 12 is adjusted so that the output voltage Vo assumes a voltage value slightly lower than a rated output voltage Voro. The output current io in this state is the maximum load current imax. Since the operation of the differential amplifier circuit A21 is stopped by the active first test signal ST1, only the first excessive current protection circuit 3 operates to protect the constant voltage power supply circuit 1 from excessive current. For this reason, even when the output voltage Vo decreases to the predetermined Vo1 or less, the output voltage Vo decreases sharply (that is, vertically) to 0 V as indicated by a broken line at the point a in FIG. 4, and a stable measurement of the maximum load current imax is possible even when the output voltage Vo slightly varies during the test operation.

Therefore, according to the constant voltage power supply circuit 1 of this first embodiment, the operation of the second excessive current protection circuit 4 is stopped during the test operation by stopping the operation of the differential amplifier circuit A21 by the active first test signal ST1, and the maximum load current imax can be accurately measured by merely adding a simple circuit.

Second Embodiment

Figure 5:
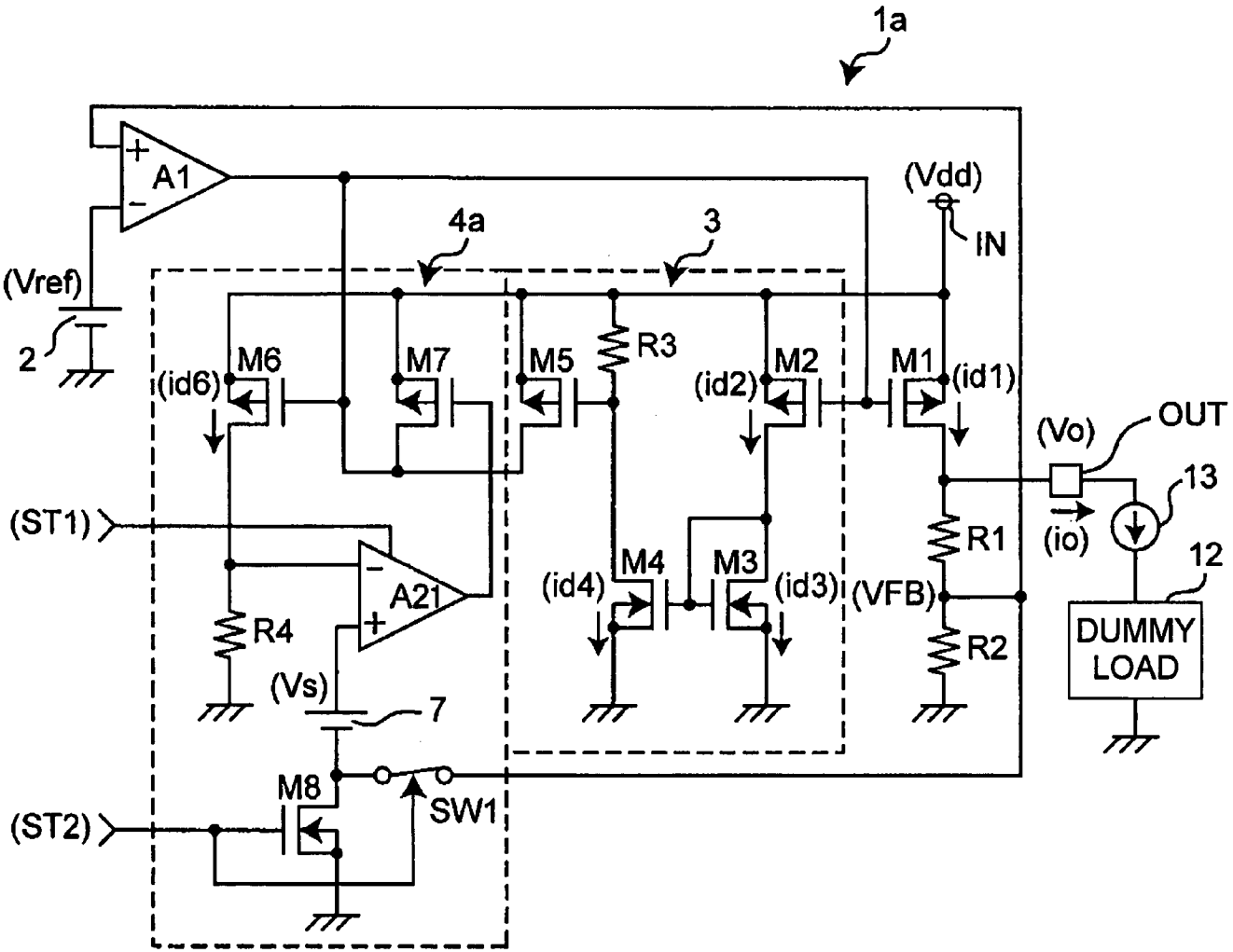
FIG. 5 is a circuit diagram showing a second embodiment of the constant voltage power supply circuit according to the present invention.

FIG. 5 is a circuit diagram showing a second embodiment of the constant voltage power supply circuit according to the present invention. This second embodiment of the constant voltage power supply circuit employs a second embodiment of the method of testing the constant voltage power supply circuit according to the present invention. In FIG. 5, those parts which are essentially the same as those corresponding parts in FIG. 3 are designated by the same reference numerals, and a description thereof will be omitted.

The first embodiment described above enables the stable and accurate measurement of the maximum load current imax. This second embodiment further enables the accurate measurement of the short-circuit current is.

A constant voltage power supply circuit 1*a* shown in FIG. 5 differs from the constant voltage power supply circuit 1 shown in FIG. 3, in that a second excessive current protection circuit 4*a* is additionally provided with an NMOS transistor M8 and a switch SW1 that are controlled by an external second test signal ST2 which is input from outside the constant voltage power supply circuit 1*a*.

That is, the constant voltage power supply circuit 1*a* shown in FIG. 5 includes the reference voltage generating circuit 2, the resistors R1 and R2 for detecting the output voltage Vo, the PMOS transistor M1 for controlling the output voltage Vo, the differential amplifier circuit A1, the first excessive current protection circuit 3, and the second excessive current protection circuit 4*a* which reduces the output voltage Vo and the output current io when the output voltage Vo is reduced to the predetermined voltage Vo1 by the first excessive current protection circuit 3.

The second excessive current protection circuit 4*a* includes the differential amplifier circuit A21, the PMOS transistors M6 and M7, the NMOS transistor M8, the resistor R4, the switch SW1 which is formed by an electronic switch, and the offset voltage generating circuit 7.

The second excessive current protection circuit 4*a* forms a second excessive current protection circuit part, and the NMOS transistor M8 and the switch SW1 form a switching circuit.

In the second excessive current protection circuit 4*a*, the gate of the PMOS transistor M6 is connected to the gate of the PMOS transistor M1, and the source of the PMOS transistor M6 is connected to the input terminal IN. The resistor R4 is connected between the drain of the PMOS transistor M6 and the ground voltage. The node connecting the PMOS transistor M6 and the resistor R4 is connected to the inverting input terminal of the differential amplifier circuit A21. The offset voltage generating circuit 7 and the NMOS transistor M8 are connected in series between the non-inverting input terminal of the differential amplifier circuit A21 and the ground voltage. The offset voltage generating circuit 7 and the switch SW1 are connected in series between the non-inverting input terminal of the differential amplifier circuit A21 and the divided voltage VFB. The operations of the NMOS transistor M8 and the switch SW1 are controlled by the second test signal ST2.

Figure 6:
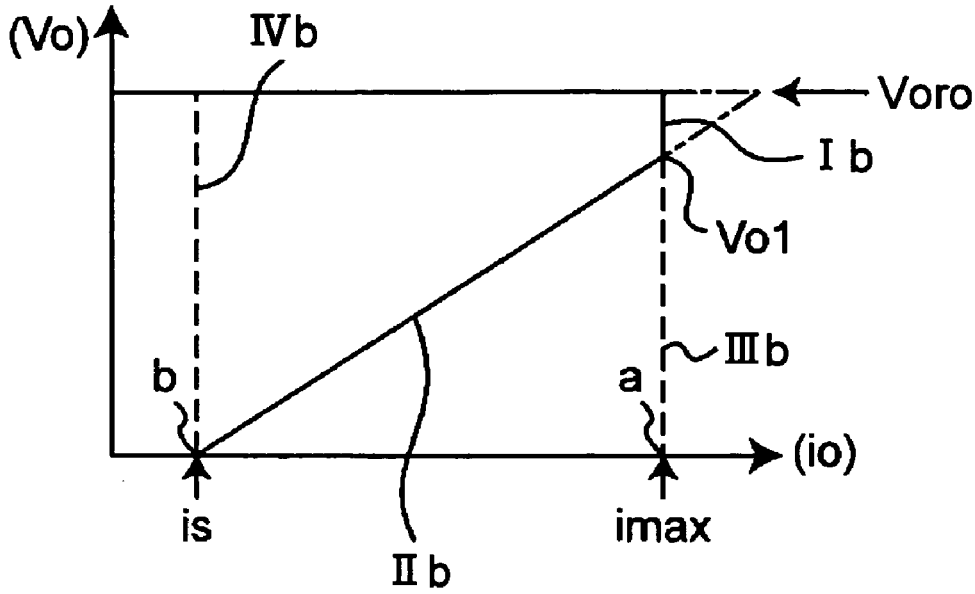
FIG. 6 is a diagram showing an output current versus output voltage characteristic of the constant voltage power supply circuit shown in FIG. 5.

FIG. 6 is a diagram showing an output current versus output voltage characteristic of the constant voltage power supply circuit 1*a* shown in FIG. 5. In FIG. 6, the ordinate indicates the output voltage Vo, and the abscissa indicates the output current io, both in arbitrary units. In FIG. 6, Ib indicates a limiting characteristic of the first excessive current protection circuit 3, IIb indicates a limiting characteristic of the second excessive current protection circuit 4*a*, IIIb indicates a characteristic of the first excessive current protection circuit 3 during the test operation, and IVb indicates a characteristic of the second excessive current protection circuit 4*a* during the test operation.

During the normal operation, the first test signal ST1 and the second test signal ST2 are both set to be inactive. Hence, the NMOS transistor M8 turns OFF to assume a non-conducting state and the switch SW1 turns ON to assume a conducting state. As a result, the constant voltage power supply circuit 1*a* operates similarly to the constant voltage power supply circuit 1 of the first embodiment during the normal operation.

Next, a description will be given of the test operation of the constant voltage power supply circuit 1*a*.

When measuring the maximum load current imax, the first test signal ST1 is set to be active and the second test signal ST2 is set to be inactive. As a result, the constant voltage power supply circuit 1*a* operates similarly to the constant voltage power supply circuit 1 of the first embodiment for the case where the first test signal ST1 is active. In this state, the ammeter 13 and the dummy load 12 are connected in series between the output terminal OUT and the ground voltage, and the dummy load 12 is adjusted so that the output voltage Vo becomes a voltage slightly lower than the rated output voltage Voro. The output current io in this state is the maximum load current imax. Since the operation of the differential amplifier circuit A21 is stopped by the active first test signal ST1, only the first excessive current protection circuit 3 operates and the second excessive current protection circuit 4*a* does not operate. For this reason, even when the output voltage Vo decreases to the predetermined Vo1 or less, the output voltage Vo decreases sharply (that is, vertically) to 0 V as indicated by a broken line at the point a in FIG. 6, and a stable measurement of the maximum load current imax is possible even when the output voltage Vo slightly varies during the test operation.

Next, when measuring the short-circuit current is, the first test signal ST1 is set to be inactive, and the second test signal ST2 is set to be active. As a result, the NMOS transistor M8 turns ON and the switch SW1 turns OFF, and the voltage which is equal to the offset voltage Vs in this case is input to the non-inverting input terminal of the differential amplifier circuit A21. Hence, the differential amplifier circuit A21 controls the operation of the PMOS transistor M1 by use of the PMOS transistor M7 so that the voltage applied to the inverting input terminal of the differential amplifier circuit A21 becomes equal to the offset voltage Vs. In other words, the divided voltage VFB is 0 V in this case, and the output voltage Vo is 0 V.

The dummy load 12 is then adjusted to adjust the output current io, and the output terminal of the differential amplifier circuit A21 assumes a high level if the output current io is lower than the short-circuit current is. The PMOS transistor M7 is turned OFF when the output terminal of the differential amplifier circuit A21 has the high level. Accordingly, the control of the PMOS transistor M1 is unaffected by the PMOS transistor M7, and the output voltage Vo is maintained at the rated output voltage Voro.

When the output current io becomes higher than or equal to the short-circuit current is, the voltage drop across the resistor R4 exceeds the offset voltage Vs. Consequently, the output voltage of the differential amplifier circuit A21 decreases, and the PMOS transistor M1 is controlled via the PMOS transistor M7, so as to suppress the increase of the output current io and sharply (that is, vertically) decrease the output voltage Vo, as indicated by a broken line at a point b in FIG. 6. Therefore, it is possible to accurately measure the short-circuit current is.

According to the constant voltage power supply circuit 1*a* of this second embodiment, it is possible to obtain similar to those obtainable by the first embodiment described above, when the first test signal ST1 is active and the second test signal ST2 is inactive. In addition, when the first test signal ST1 is inactive and the second test signal ST2 is active, the output terminal of the differential amplifier circuit A21 assume the same state as when the output voltage Vo becomes 0 V, and by adjusting the dummy load 12 in this state, it is possible to sharply (that is, vertically) decrease the output voltage Vo and accurately measure the short-circuit current is.

Third Embodiment

Figure 7:
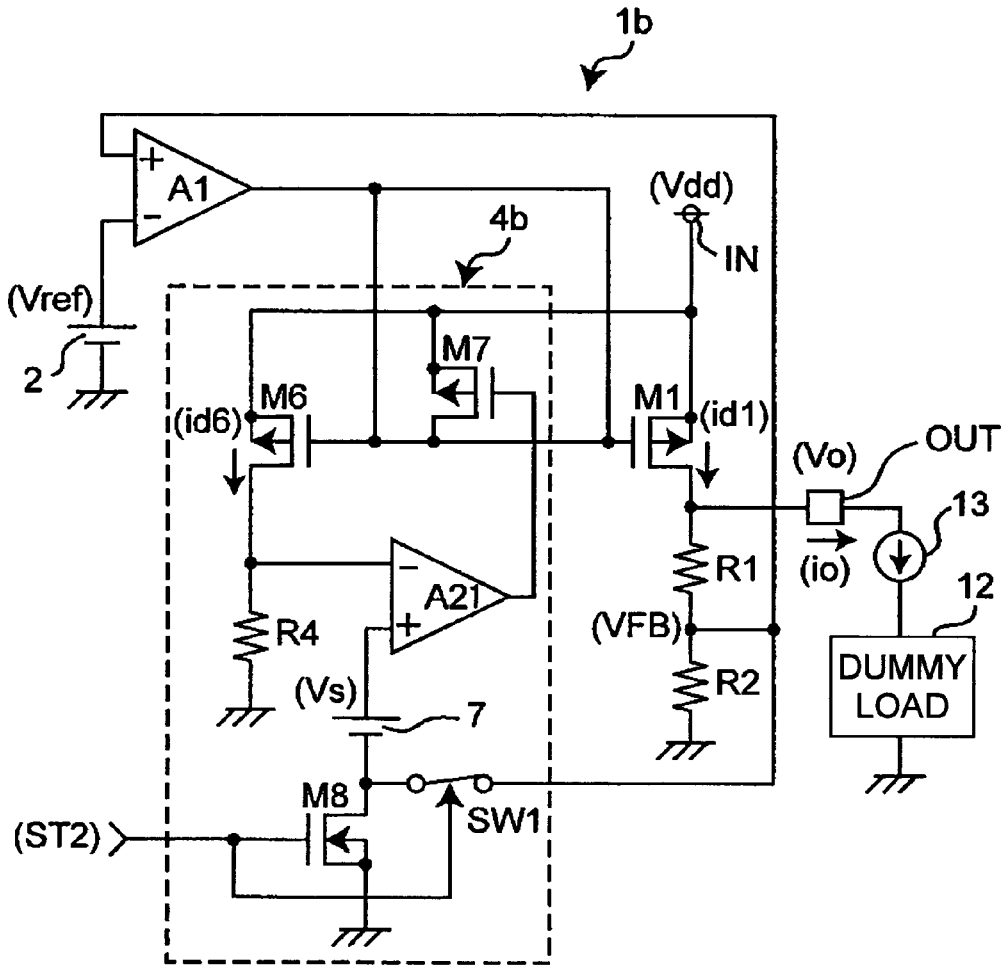
FIG. 7 is a circuit diagram showing a third embodiment of the constant voltage power supply circuit according to the present invention.

FIG. 7 is a circuit diagram showing a third embodiment of the constant voltage power supply circuit according to the present invention. This third embodiment of the constant voltage power supply circuit employs a third embodiment of the method of testing the constant voltage power supply circuit according to the present invention. In FIG. 7, those parts which are essentially the same as those corresponding parts in FIG. 3 are designated by the same reference numerals.

The second embodiment described above enables the measurement of both the maximum load current imax and the short-circuit current is. In this third embodiment, only the short-circuit current is needs to be measured, and thus, the first excessive current protection circuit 3 is omitted.

A constant voltage power supply circuit 1*b* of this third embodiment shown in FIG. 7 differs from the constant voltage power supply circuit 1 shown in FIG. 3, in that the first excessive current protection circuit 3 and the first test signal ST1 are omitted and only a second excessive current protection circuit 4*b* is provided as the excessive current protection circuit.

The constant voltage power supply circuit 1*b* shown in FIG. 7 includes the reference voltage generating circuit 2, the resistors R1 and R2 for detecting the output voltage Vo, the PMOS transistor M1 for controlling the output voltage Vo, the differential amplifier circuit A1, and the second excessive current protection circuit 4*b* which reduces the output voltage Vo and reduces the output current io when the output current io increases to a predetermined current value.

The second excessive current protection circuit 4*b* includes the differential amplifier circuit A21, the PMOS transistors M6 and M7, the NMOS transistor M8, the resistor R4, the switch SW1 that is formed by an electronic switch, and the offset voltage generating circuit 7.

In the second excessive current protection circuit 4*b*, the gate of the PMOS transistor M6 is connected to the gate of the PMOS transistor M1, and the source of the PMOS transistor M6 is connected to the input terminal IN. The resistor R4 is connected between the drain of the PMOS transistor M6 and the ground voltage. The node connecting the PMOS transistor M6 and the resistor R4 is connected to the inverting input terminal of the differential amplifier circuit A21. The offset voltage generating circuit 7 and the NMOS transistor M8 are connected in series between the non-inverting input terminal of the differential amplifier circuit A21 and the ground voltage. The offset voltage generating circuit 7 and the switch SW1 are connected in series between the non-inverting input terminal of the differential amplifier circuit A21 and the divided voltage VFB. The operations of the NMOS transistor M6 and the switch SW1 are controlled by the external second test signal ST2.

Figure 8:
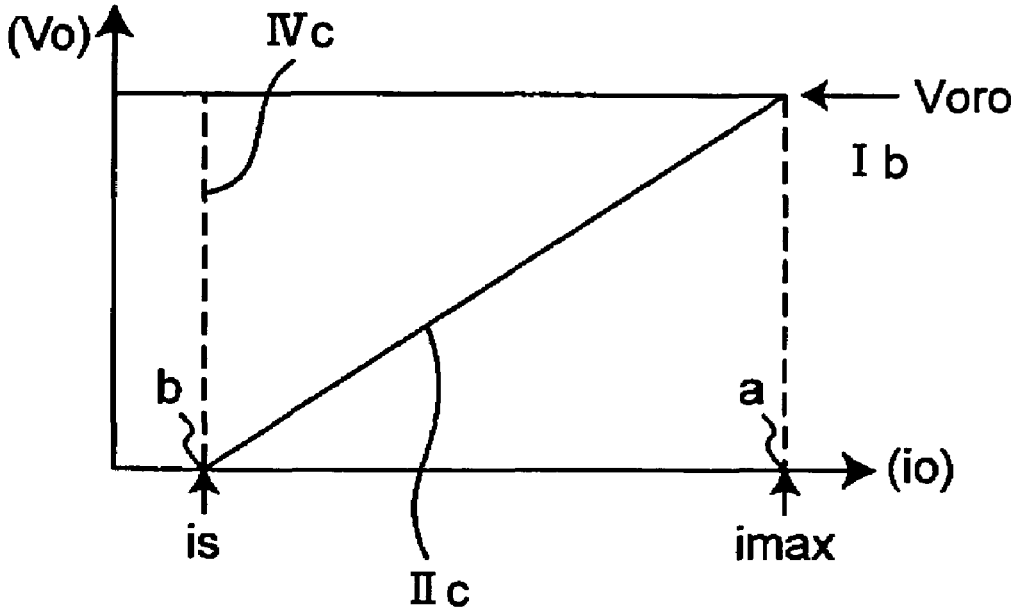
FIG. 8 is a diagram showing an output current versus output voltage characteristic of the constant voltage power supply circuit shown in FIG. 7.

FIG. 8 is a diagram showing an output current versus output voltage characteristic of the constant voltage power supply circuit shown in FIG. 7. In FIG. 8, the ordinate indicates the output voltage Vo, and the abscissa indicates the output current io, both in arbitrary units. In FIG. 8, IIc indicates a limiting characteristic of the second excessive current protection circuit 4*b*, and IVc indicates a characteristic of the second excessive current protection circuit 4*b* during the test operation.

Next, a description will be given of the operation of the second excessive current protection circuit 4*b* shown in FIG. 7, by referring to FIG. 8.

During the normal operation, the second test signal ST2 is set to be inactive. Hence, the NMOS transistor M8 turns OFF to assume the non-conducting state, and the switch SW1 turns ON to assume the conducting state. For this reason, the constant voltage power supply circuit 1*b* operates similarly to the constant voltage power supply circuit 1 of the first embodiment during the normal operation.

Next, a description will be given of the test operation of the constant voltage power supply circuit 1*b*.

When measuring the short-circuit current is, the second test signal ST2 is set to be active. For this reason, the NMOS transistor M8 turns ON, the switch SW1 turns OFF, and the voltage which is equal to the offset voltage Vs in this case is input to the non-inverting input terminal of the differential amplifier circuit A21. Hence, the differential amplifier circuit A21 controls the operation of the PMOS transistor M1 by use of the PMOS transistor M7 so that the voltage applied to the inverting input terminal of the differential amplifier circuit A21 becomes equal to the offset voltage Vs. In other words, the divided voltage VFB is 0 V in this case, and the output voltage Vo is 0 V.

The dummy load 12 is then adjusted to adjust the output current io, and the output terminal of the differential amplifier circuit A21 assumes a high level if the output current io is lower than the short-circuit current is. The PMOS transistor M7 is turned OFF when the output terminal of the differential amplifier circuit A21 has the high level. Accordingly, the control of the PMOS transistor M1 is unaffected by the PMOS transistor M7, and the output voltage Vo is maintained at the rated output voltage Voro.

When the output current io becomes higher than or equal to the short-circuit current is, the voltage drop across the resistor R4 exceeds the offset voltage Vs. Consequently, the output voltage of the differential amplifier circuit A21 decreases, and the PMOS transistor M1 is controlled via the PMOS transistor M7, so as to suppress the increase of the output current io and sharply (that is, vertically) decrease the output voltage Vo, as indicated by a broken line at a point b in FIG. 8. Therefore, it is possible to accurately measure the short-circuit current is.

It is not essential to provide the switch SW1, and the divided voltage VFB may be input directly to the node that connects the NMOS transistor MB and the offset voltage generating circuit 7. In this case, however, the voltage at the non-inverting input terminal of the differential amplifier circuit A21 also decreases to 0 V when measuring the short-circuit current is, and the output voltage Vo is no longer controlled, such that the voltage at the output terminal OUT becomes approximately equal to the power supply voltage Vdd. But when the dummy load 12 is connected and the output current io exceeds the short-circuit current is, the second excessive current protection circuit 4*b* starts to operate, and the output voltage Vo is sharply (that is, vertically) decreased as indicated by the broken line at the point b in FIG. 8. Therefore, it is possible to accurately measure the short-circuit current is.

According to the constant voltage power supply circuit 1*b* of this third embodiment, when the second test signal ST2 is set to be active, the constant voltage power supply circuit 1*b* assumes a pseudo state which is as if the non-inverting input terminal of the differential amplifier circuit A21 were in the state where the output voltage Vo is 0V. For this reason, by adjusting the dummy load 12 in this pseudo state, it is possible to sharply (that is, vertically) decrease the output voltage Vo, and accurately measure the short-circuit current is.

In each of the first through third embodiments described above, the offset voltage generating circuit 7 is provided separately or independently of the differential amplifier circuit A21. However, instead of providing the offset voltage generating circuit 7 externally to the differential amplifier circuit A21, it is possible to provide the offset voltage generating circuit 7 within the differential amplifier circuit A21. For example, it is possible to make the element sizes of two input transistors forming the differential pair of the differential amplifier circuit A21 different, so that a predetermined offset voltage is generated at the non-inverting input terminal of the differential amplifier circuit A21. In this case, the offset voltage generating circuit 7 shown in FIG. 3 is omitted so that the divided voltage VFB is input to the non-inverting input terminal of the differential amplifier circuit A21. Further, the offset voltage generating circuit 7 shown in each of FIGS. 5 and 7 is omitted and the non-inverting input terminal of the differential amplifier circuit A21 is connected to the node that connects the drain of the NMOS transistor M8 and the switch SW1.

This application claims the benefit of a Japanese Patent Application No. 2005-075229 filed Mar. 16, 2005, in the Japanese Patent Office, the disclosure of which is hereby incorporated by reference.

Further, the present invention is not limited to these embodiments, but various variations and modifications may be made without departing from the scope of the present invention.

What is claimed is:

1. A constant voltage power supply circuit for converting an input voltage received via an input terminal into a predetermined constant voltage that is output via an output terminal to a load which is coupled to the output terminal, comprising:

a constant voltage circuit part configured to convert the input voltage into the predetermined constant voltage;

a first excessive current protection circuit part configured to control the constant voltage circuit part so as to reduce the output voltage while maintaining an output current that is output via the output terminal to a predetermined maximum value if the output current is greater than or equal to the predetermined maximum value when the output voltage is a rated voltage; and a second excessive current protection circuit part configured to control the constant voltage circuit part so as to reduce the output voltage and the output current and to output a short-circuit current via the output terminal if the output voltage decreases to a ground voltage when the output voltage is decreased to a predetermined value by the first excessive current protection circuit part, wherein the second excessive current protection circuit part is disabled in response to a first test signal that is active.

2. The constant voltage power supply circuit as claimed in claim 1, wherein:

the constant voltage circuit part comprises:

a transistor configured to output to the output terminal a current that is dependent upon a signal input to a control electrode thereof; and an output voltage control part configured to generate a reference voltage and a voltage proportional to the output voltage, and to output to the control electrode of the transistor the signal by amplifying an error between the reference voltage and the voltage proportional to the output voltage, and the second excessive current protection circuit part comprises:

a current-to-voltage conversion circuit configured to convert the output current from the output terminal into a voltage proportional to the output current; and a control circuit, including an offset voltage generating part that is configured to generate a voltage that is a sum of the voltage proportional to the output voltage and an offset voltage, and configured to control the transistor so that the voltage proportional to the output current becomes equal to the voltage generated by the offset voltage generating part, wherein the control circuit stops controlling the transistor in response to the first test signal that is active.

3. The constant voltage power supply circuit as claimed in claim 1, wherein the second excessive current protection circuit part controls the constant voltage circuit part to reduce the output voltage to the ground voltage if the output current becomes greater than or equal to the short-circuit current in response to the first test signal that is inactive and a second test signal that is active.

4. The constant voltage power supply circuit as claimed in claim 3, wherein:

the constant voltage circuit part comprises:

a transistor configured to output to the output terminal a current that is dependent upon a signal input to a control electrode thereof; and an output voltage control part configured to generate a reference voltage and a voltage proportional to the output voltage, and to output to the control electrode of the transistor the signal by amplifying an error between the reference voltage and the voltage proportional to the output voltage, and the second excessive current protection circuit part comprises:

a current-to-voltage conversion circuit configured to convert the output current from the output terminal into a voltage proportional to the output current;

a switching circuit configured to exclusively output one of the voltage proportional to the output voltage and the ground voltage; and a control circuit, including an offset voltage generating part that is configured to generate a voltage that is a sum of the voltage output from the switching circuit and an offset voltage, and configured to control the transistor so that the voltage proportional to the output current becomes equal to the voltage generated by the offset voltage generating part, wherein the control circuit stops controlling the transistor in response to the first test signal that is active, and the switching circuit outputs the ground voltage in response to the second test signal that is active.

5. A constant voltage power supply circuit for converting an input voltage received via an input terminal into a predetermined constant voltage that is output via an output terminal to a load which is coupled to the output terminal, comprising:

a constant voltage circuit part configured to convert the input voltage into the predetermined constant voltage; and a second excessive current protection circuit part configured to control the constant voltage circuit part so as to reduce the output voltage and an output current that is output from the output terminal and to output a short-circuit current via the output terminal if the output voltage decreases to a ground voltage when the output current is greater than or equal to a predetermined maximum value in a state where the output voltage is a rated voltage, wherein the second excessive current protection circuit part controls the constant voltage circuit part to reduce the output voltage to the ground voltage when the output current becomes greater than or equal to the short-circuit current in response to a second test signal that is active.

6. The constant voltage power supply circuit as claimed in claim 5, wherein:

the constant voltage circuit part comprises:

a transistor configured to output to the output terminal a current that is dependent upon a signal input to a control electrode thereof; and an output voltage control part configured to generate a reference voltage and a voltage proportional to the output voltage, and to output to the control electrode of the transistor the signal by amplifying an error between the reference voltage and the voltage proportional to the output voltage, and the second excessive current protection circuit part comprises:

a current-to-voltage conversion circuit configured to convert the output current from the output terminal into a voltage proportional to the output current;

a switching circuit configured to exclusively output one of the voltage proportional to the output voltage and the ground voltage; and a control circuit, including an offset voltage generating part that is configured to generate a voltage that is a sum of the voltage output from the switching circuit and an offset voltage, and configured to control the transistor so that the voltage proportional to the output current becomes equal to the voltage generated by the offset voltage generating part, wherein the switching circuit output the ground voltage in response to the second test signal that is active.

7. A method of testing a constant voltage power supply circuit comprising a constant voltage circuit part configured to convert an input voltage that is input via an input terminal into a predetermined constant voltage that is output via an output terminal, a first excessive current protection circuit part configured to control the constant voltage circuit part so as to reduce the output voltage while maintaining an output current that is output via the output terminal to a predetermined maximum value if the output current is greater than or equal to the predetermined maximum value when the output voltage is a rated voltage, and a second excessive current protection circuit part configured to control the constant voltage circuit part so as to reduce the output voltage and the output current and to output a short-circuit current via the output terminal if the output voltage decreases to a ground voltage when the output voltage is decreased to a predetermined value by the first excessive current protection circuit part, said method comprising:

stopping operation of the second excessive current protection circuit part in response to a first test signal that is active;

reducing the output voltage to the ground voltage by adjusting a current flowing to a load that is coupled to the output terminal; and measuring the output current.

8. The method of testing the constant voltage power supply circuit as claimed in claim 7, wherein the first test signal that is active is input to the constant voltage power supply circuit when measuring a maximum value of the output current.

9. The method of testing the constant voltage power supply circuit as claimed in claim 7, further comprising, prior to measuring the output current:

operating the second excessive current protection circuit part in response to the first test signal that is inactive;

releasing an input end configured to receive a voltage proportional to the output voltage by the second excessive current protection circuit part in response to a second test signal that is active;

controlling the input end to the ground voltage by the second excessive current protection circuit part regardless of the output voltage; and adjusting a current flowing to a load that is coupled to the output terminal so as to reduce the output voltage to the ground voltage.

10. The method of testing the constant voltage power supply circuit as claimed in claim 9, wherein the first test signal that is active is input to the constant voltage power supply circuit when measuring a maximum value of the output current.

11. The method of testing the constant voltage power supply circuit as claimed in claim 10, wherein the second test signal that is active is input to the constant voltage power supply circuit when measuring the short-circuit current.

12. The method of testing the constant voltage power supply circuit as claimed in claim 9, wherein the second test signal that is active is input to the constant voltage power supply circuit when measuring the short-circuit current.

13. A method of testing a constant voltage power supply circuit comprising a constant voltage circuit part configured to convert an input voltage that is input via an input terminal into a predetermined constant voltage that is output via an output terminal, and a second excessive current protection circuit part configured to control the constant voltage circuit part so as to reduce the output voltage and an output current that is output from the output terminal and to output a short-circuit current via the output terminal if the output voltage decreases to a ground voltage when the output current is greater than or equal to a predetermined maximum value in a state where the output voltage is a rated voltage, said method comprising:

releasing an input end configured to receive a voltage proportional to the output voltage by the second excessive current protection circuit part in response to a second test signal that is active;

controlling the input end to the ground voltage by the second excessive current protection circuit part regardless of the output voltage;

adjusting a current flowing to a load that is coupled to the output terminal so as to reduce the output voltage to the ground voltage; and measuring the output current.

14. The method of testing the constant voltage power supply circuit as claimed in claim 13, wherein the second test signal that is active is input to the constant voltage power supply circuit when measuring the short-circuit current.

* * * * *